US005988903A

United States Patent [19]

Baitz et al.

[11] Patent Number: 5,988,903

[45] Date of Patent: Nov. 23, 1999

[54] PRINTER FOR PRINTING ON SINGLE SHEETS AND AN ENDLESS PAPER STRIP

[75] Inventors: Günter Baitz; Wolfgang Malke, both of Berlin, Germany

[73] Assignee: Siemens Nixdorf Informationssysteme AG, Paderborn, Germany

[21] Appl. No.: 09/254,765

[22] PCT Filed: Jan. 28, 1998

[86] PCT No.: PCT/DE98/00245

§ 371 Date: Mar. 11, 1999

§ 102(e) Date: Mar. 11, 1999

[87] PCT Pub. No.: WO98/40219

PCT Pub. Date: Sep. 17, 1998

[30] Foreign Application Priority Data

Mar. 11, 1997 [DE] Germany ..... 197 09 941

[51] Int. Cl.[6] ..... B41J 11/50

[52] U.S. Cl. ..... 400/605; 400/621; 400/625; 400/634; 347/104

[58] Field of Search ..... 400/605, 611, 400/616, 616.1, 629, 625, 635, 636, 641; 347/104

[56] References Cited

U.S. PATENT DOCUMENTS

| | | | |
|---|---|---|---|
| 5,100,251 | 3/1992 | Yasuuka | 400/616.1 |
| 5,123,761 | 6/1992 | Rosenthal | 400/605 |
| 5,328,281 | 7/1994 | Narita et al. | 400/605 |
| 5,564,842 | 10/1996 | Kida et al. | 400/629 |
| 5,718,526 | 2/1998 | Yokota | 400/605 |
| 5,815,186 | 9/1998 | Lewis et al. | 400/605 |

FOREIGN PATENT DOCUMENTS

| | | |
|---|---|---|
| 0 123 310 | 4/1983 | European Pat. Off. . |
| 0 166 132 | 6/1984 | European Pat. Off. . |
| 0 566 159 | 9/1988 | European Pat. Off. . |
| WO 91/13765 | 3/1990 | Germany . |
| 07 265 959 | 6/1994 | Japan . |

*Primary Examiner*—Eugene Eickholt
*Attorney, Agent, or Firm*—Hill & Simpson

[57] ABSTRACT

A printer (10) for printing single sheets (126, 128) and at least one continuous paper strip (122) on a printing substrate plane (19), in which a single sheet (126, 128) is led up to the printing station (36, 56) from the operator side by being displaced manually on a feed table (20) and, in said printing station, can overlap the continuous paper strip (122), at least over part of the width of the latter. The continuous paper strip (122) is fed to the printing station (36, 56) from the operating side and the continuous paper feed channel (34) and the single-sheet feed channel (30) are each assigned a driven feed roller (98; 38) of a pair of feed rollers (100; 44). A mating roller (42) that is arranged on a rocker (48) can be pressed optionally against the driven feed roller (98; 38) of the continuous paper feed channel (34) or the single-sheet feed channel (30).

20 Claims, 4 Drawing Sheets

PRINTER FOR PRINTING ON SINGLE SHEETS AND AN ENDLESS PAPER STRIP

BACKGROUND OF THE INVENTION

Field of the Invention

The present invention relates generally to a printer capable of printing a single sheet as well as at least one continuous strip of paper.

A printer of the type mentioned is disclosed by WO 91/13765 A1. In that patent, a matrix printing head with its needle mouthpiece pointing upward is arranged underneath a printing substrate plane, and the printer housing can be folded up in the plane of the printing substrate. A paper supply roll and a wind-up roll and a cutting device for a continuous paper strip are accommodated so that they are easily accessible in the upper part of the printer housing, which makes the threading of the start of a new continuous paper strip considerably easier. The arrangement has the further advantage that a single sheet and the continuous paper strip(s) can be fed to the plane of the printing substrate and led away from the latter over completely separate paths, so that a continuous paper strip which is always located in the printer and a single sheet can overlap. In order for it to be printed, a single sheet is pushed between the printing head and the endless paper strip on a level, horizontally aligned feed table. Following printing, the single sheet is transported out of the printer by pairs of transport rollers which are intended only for single-sheet transport. The continuous paper strip is then located directly in front of the printing head again and can be printed.

The advantages of the known arrangement cannot be transferred to a printer having an inkjet printing head since, as is known, such printing heads cannot print upward from below. Simply exchanging the printing head and printing support does not solve the problem, since a continuous paper web which is always located in the printer would shield a single sheet from the printing head. On the other hand, the handling of a printer substrate which is common in office printers, in which a continuous paper strip is pulled back out of the printing area before a single sheet is threaded, is impractical in the case of a cashdesk printer. Here, it is necessary to change continually between document and counterfoil printing, and too much time would be needed to pull back and re-feed the continuous paper strip which is normally used for counterfoil printing. In the case of a journal recording, in which a continuous paper strip is unwound from a supply roll and, behind the printing station, is wound up onto a wind-up roll, such a method could not be used in any case.

Therefore, there is a need for a printer having a printing station for printing a single sheet and at least one continuous paper strip on a single printing substrate plane, which is suitable for the use of an inkjet printing head.

SUMMARY OF THE INVENTION

The invention is based on the idea that an inkjet printing head can be used as a single printing head in a cashdesk printer with the possibility of printing on a single sheet and at least one continuous paper strip if the continuous paper strip is fed to the printing station from the operating side. The printing head can then be inclined downward in such a way that its printing direction makes an angle $0° < \alpha < 90°$ with the horizontal. The more or less steep declivity of the printing-head nozzles ensures reliable ink flow until the end of the ink supply.

The abovedescribed problems of overlapping paper guidance are in this case eliminated in that the at least one continuous paper strip, for whose supply roll space can be found only in the rear top area of the printer, is fed to the printing station from below, through and under the printing support. A single sheet which is fed from the front over a feed table—which, for ergonomic reasons, is arranged in the lower area of the printer—can then come to lie in front of the continuous paper strip. By comparison with the known printer, the arrangement has the further advantage that the single sheets also leave the printer with the printed side pointing upward.

The feed channels underneath the printing head are combined in a particularly simple and space-saving way by the continuous paper feed channel and the single-sheet feed channel each being assigned a roller, driven in the paper conveying direction, of a pair of feed rollers, and a co-rotating mating roller that is arranged on a rocker being able to be pressed optionally against the feed roller of one feed channel or of the other feed channel. This necessarily involves an alternating forward drive of a continuous paper strip or of the single sheet, paper collision being reliably avoided. The rocker can be displaced by an electromagnet or else by a stepping motor.

It is preferable if a discharge channel which is common to the single sheet and to the at least one continuous paper strip and which has at least one pair of discharge rollers which comprises a driven discharge roller is arranged behind the printing station—as viewed in the paper transport direction. In one embodiment of the inventive printer, with which in each case individual sections of a continuous paper strip, such as cashdesk counterfoils, for example, are to be printed, a cutting station is arranged behind the printing head, at least in that area of the printing station which is occupied by this continuous paper strip. This cutting station comprises a cutting wheel which is known per se and interacts with a cutting rail, can be coupled to the printing head carrier and can be transported by the latter over the entire width of the printing station. However, other cutting devices, such as a knife blade which can be displaced at right angles to the printing substrate plane or a cutting cylinder having a knife helix can also be used.

The cutting station may be arranged in front of or behind the pair of discharge rollers—as viewed in the paper transport direction. In the first case, the loss of paper in the head area of a counterfoil is particularly low, but it is necessary for the pair of discharge rollers to be operated once more following the cutting operation. This is rendered superfluous in the second case.

The supply roll of the at least one continuous paper strip is, as already mentioned, accommodated in the rear area of the printer. In order to make threading the start of a new continuous paper strip easier, the continuous paper feed channel reaches as far as the top of the printer. In a development of the invention, the inlet area of this feed channel therefore contains a pair of threading rollers, which can be engaged with the continuous paper strip only when the rocker is pressing the mating roller against the driven continuous paper feed roller.

A particularly simple construction of the threading area results if the driven discharge roller is at the same time the driven roller of the pair of threading rollers, and its co-rotating threading roller is arranged on one arm of a lever. As a result of a threading push-button being operated, the lever is pivoted and, as a result, the co-rotating threading roller is pressed against the driven threading roller. An actuating lever is coupled to the rocker and clears the pivoting path of the lever only when the rocker is pivoted in the direction of the continuous paper feed channel.

In a different development of the invention, a document stop which extends parallel to the direction of a line of print is arranged on the rocker above the pair of feed rollers—as viewed in the paper transport direction—and opens the single-sheet feed channel only when the rocker is pivoted in the direction of the single-sheet feed channel. In the basic position of the printer, the rocker is in the position in which the mating roller is lifted off the roller of the single-sheet feed channel. The document stop thus blocks this feed channel. A single sheet which is pushed into the single-sheet feed channel strikes the document stop and, as a result, is aligned parallel to the line of print. As soon as this has occurred, said single sheet interrupts the beam path of a light barrier which is arranged underneath the document stop, whereupon the displacement drive of the rocker displaces the latter in the direction of the single-sheet feed channel. The mating roller is pressed against the roller of the single-sheet feed channel and, as a result, the single sheet is gripped. At the same time, a window which is formed in the document stop clears the single-sheet feed channel and the pair of feed rollers, which have been set rotating, are able to convey the single sheet into the printing station.

In order also to be able to print small-format single sheets, such as check forms, for example, according to another development of the invention an inner pair of discharge rollers, which are driven in synchronism with the first-mentioned outer pair of discharge rollers, are arranged in the discharge channel between the printing head and the pair of discharge rollers. This inner pair of rollers extends over the entire width of a line of print but leaves free that area which is occupied by the at least one continuous paper strip, so that the latter cannot inadvertently be transported at the same time by the transport of a single sheet.

In an embodiment, the present invention provides a printer which includes a printer station comprising a printer support and a printing head for printing both on a single sheet as well as a continuous strip. The printing station is in communication with a single feed channel and a continuous feed channel. The single feed channel is in communication with a feed table. The continuous feed channel is in communication with a strip roll. The single sheet is driven through the single feed channel to the printing station by a single sheet roller and a mating roller. The continuous paper strip is driven through the continuous feed channel to the printing station by a continuous feed roller and the mating roller. The mating roller is connected to a rocker pivotally mounted to the printer so that the mating roller can be pivoted between a first position where the mating roller engages the single sheet roller for driving the single sheet towards the printing station and a second position where the mating roller engages the continuous feed roller for driving the continuous strip towards the printing station.

In an embodiment, the printer further comprises a discharge channel in communication with the printing station for outputting both the single sheet and the continuous strip. The printer further comprises a first pair of discharge rollers including a discharge roller and a driven roller, both of which are disposed at least partially in the discharge channel and on opposing sides thereof and downstream of the printing station.

In an embodiment, the printer further comprises a cutting station disposed between the discharge roller and the printing station.

In an embodiment, the printer further comprises a pair of threading rollers disposed at least partially in the continuous feed channel between the continuous feed roller and the strip roll. The threading rollers sandwiching the continuous strip only when the mating roller is in the second position.

In an embodiment, one of the threading rollers is the driven roller and the driven roller is disposed at least partially in the continuous feed channel. The other of the threading rollers is connected to a lever and moves into an engagement with the driven roller for sandwiching the continuous strip between the threading roller and the driven roller only when the mating roller is in the second position.

In an embodiment, the rocker is connected to an actuating arm. The actuating arm blocks movement of the threading roller towards the driven roller when the rocker is in the first position.

In an embodiment, movement of the lever is actuated by a threading push-button.

In an embodiment, the printer further comprises a document stop disposed between the printing station and the single sheet and mating rollers. The document stop is connected to the rocker and permits the single sheet to be fed to the printing station only when the rocker is in the first position.

In an embodiment, the printer further comprises a second pair of discharge rollers which are driven in synchronism with the driven roller. The second pair of discharge rollers is disposed at least partially in the discharge channel and on opposing sides thereof and between the printing station and the driven roller. The second pair of discharge rollers do not engage the continuous strip.

In an embodiment, the printing head is an inkjet printing head.

Other objects and advantages of the present invention will become apparent from reading the following detailed description and appended claims, and upon reference to the accompanying drawings.

BRIEF DESCRIPTION OF THE DRAWINGS

Further features and advantages of the invention emerge from the following description which, in conjunction with the appended drawings, explain the invention using an exemplary embodiment. In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
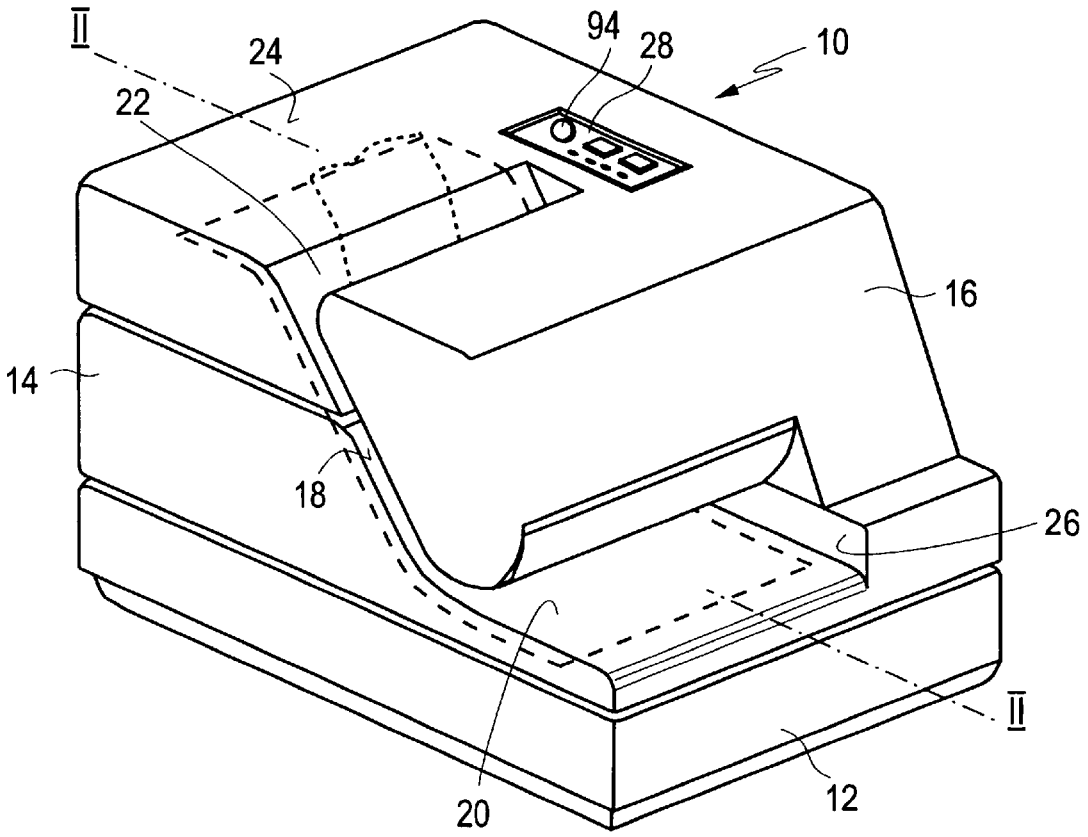
FIG. 1 is a perspective view of a printer made in accordance with the present invention.

In FIG. 1, a printer is designated generally by 10. It comprises an electronics box 12, in which, inter alia, control electronics for the printer are accommodated, a lower housing part 14 and an upper housing part 16. A printing substrate slot 18 which rises diagonally to the rear from the bottom front passes through the housing parts 14, 16. The printing substrate slot 18 merges at the front into an essentially horizontal feed table 20 and opens at the rear in a discharge opening 22 on the top surface 24 of the upper housing part 16. The feed table 20 is bounded on the right-hand side in FIG. 1 by a vertical stop wall 26 and is open at the left, as is the printing substrate slot 18. In addition, an operating panel 28 with a number of push-buttons is let into the top surface 24, one of said push-buttons being a threading push-button 94 which is described further below.

Figure 2:
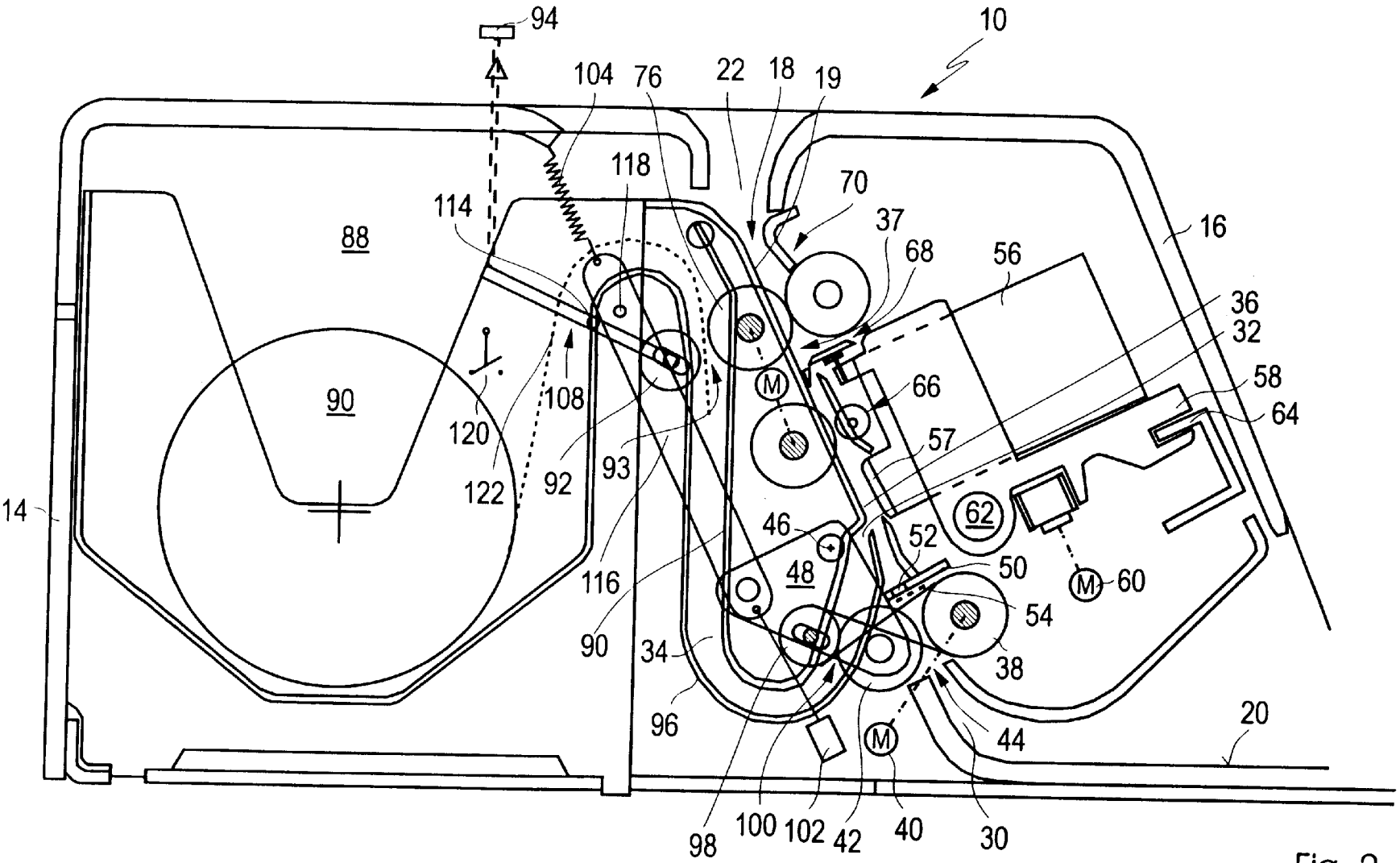
FIG. 2 is a sectional view taken substantially along line II—II of FIG. 1, when the printer of the present invention is in a rest position.

FIG. 2 shows a side view, sectioned along the line II—II in FIG. 1, of the printer 10 in the rest position, but without the electronics box 12. It can be seen that a single-sheet feed channel 30, the tangential opening 32 of a continuous paper feed channel 34, a printing support 36 and a discharge channel 37 are constructed one behind another—as viewed in the paper transport direction, that is to say from bottom to top—at the printing substrate slot 18, whose rear wall 19 forms the printing substrate plane.

A single-sheet feed roller 38 that can be driven by a feed motor 40 penetrates the single-sheet feed channel 30 from the forward-pointing side of the printing substrate slot 18, and a co-rotating mating roller 42 of a pair of single-sheet feed rollers 44 penetrates said single-sheet feed channel 30 from the rear. The mating roller 42 is rotatably mounted on a rocker 48 which can pivot about a pivot axis 46, and its rocker can be used to displace said mating roller 42 between a position in which it is pressed against the single-sheet feed roller 38 and a position in which it is lifted off the latter. In FIG. 2, the mating roller 42 is illustrated in its position in which it is lifted off the single-sheet feed roller 38.

Fitted to the rocker 48, above the pair of single-sheet feed rollers 44, is a document stop 50 which extends over the entire width of the printing substrate slot 18 and is provided with a window 52. Directly in front of the document stop 50 there is a light barrier 54 (illustrated only symbolically) in the single-sheet feed channel 30. Opposite the printing support 36 is an inkjet printing head 56 with its nozzle plate 57. The inkjet printing head 564 is held on a printing-head carrier 58 which, for its part, can be displaced along the printing support 36 on rails 62, 64, while being driven by a carrier motor 60.

Figure 3:
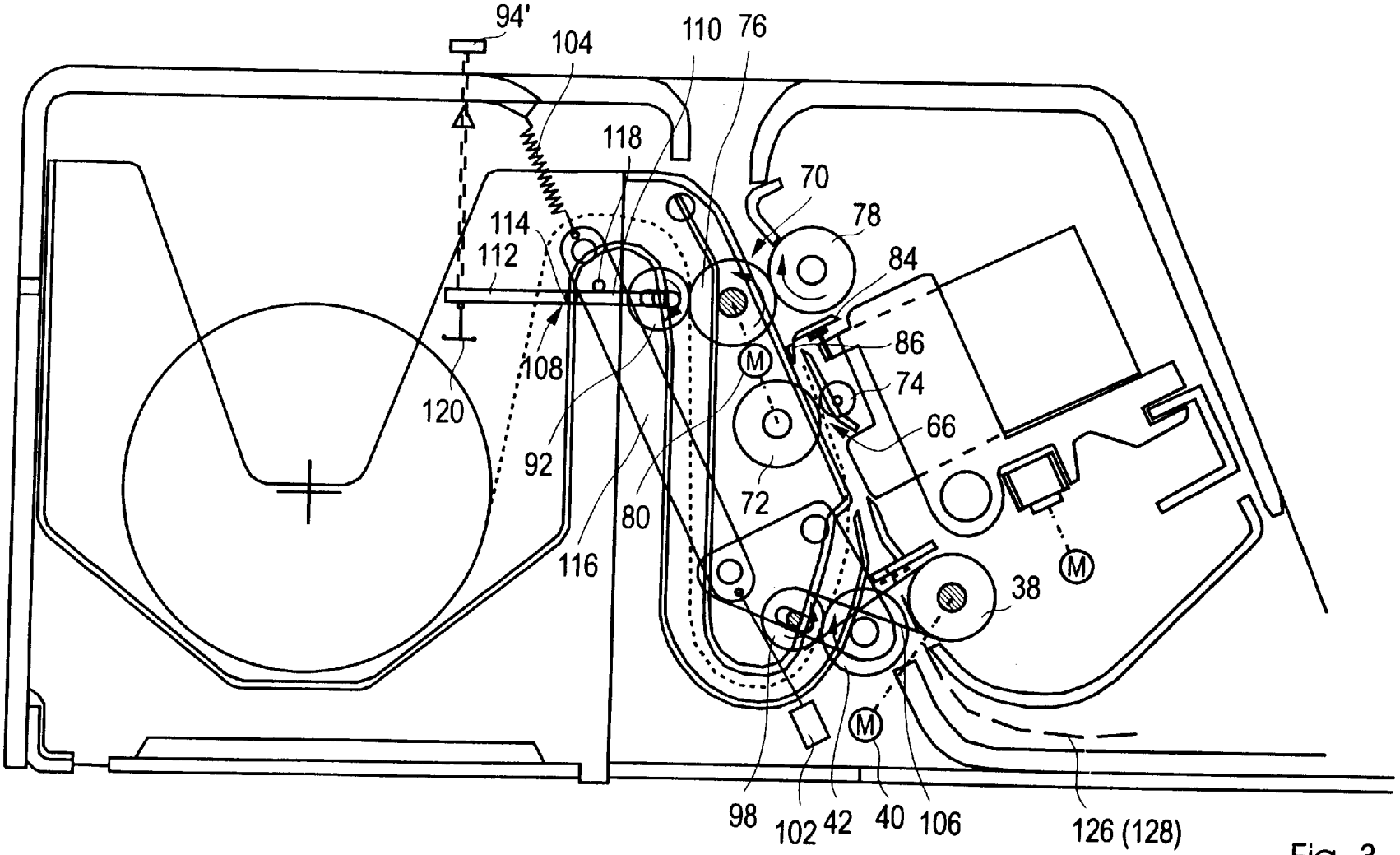
FIG. 3 is another sectional view of the printer shown in FIG. 1, but in a "thread continuous paper strip" mode of operation.

The discharge channel 37, which extends as far as the outlet opening 22, begins above the printing support 36. Arranged one behind another—as viewed in the paper conveying direction—this discharge channel contains an inner pair of discharge rollers 66, a cutting station 68 and an outer pair of discharge rollers 70. The inner pair of discharge rollers 66 comprises an inner driven discharge roller 72 and an inner co-rotating discharge roller 74, and the outer pair of discharge rollers 70 comprises an outer driven discharge roller 76 and an outer co-rotating discharge roller 78 (FIG. 3). The discharge rollers 72 and 76 are driven in synchronism by a discharge motor 80.

The cutting station 68 comprises a knife wheel 84 which is rotatably mounted on a knife carrier 82 (FIG. 5), can be coupled in a manner known per se to the printing-head carrier 58 and then be pulled by the latter over the width of the discharge channel 37. The knife wheel 84 runs along on the cutting edge of a cutting rail 86.

The continuous paper feed channel 34 is approximately S-shaped. It begins at the upper edge of a holding trough 88 for a paper supply roll 90 and ends, as described, at its opening 32 in the printing substrate slot 18. Part of the circumference of the outer driven discharge roller 76 protrudes through a boundary wall 90 of the continuous paper feed channel 34 and, with a co-rotating threading roller 92, forms a pair of threading rollers 93. In its rest position, the co-rotating threading roller 92 is, as described further below, lifted off the outer driven discharge roller 76, but can be pressed against the latter as a result of the threading push-button 94 being operated.

In the lower area of the continuous paper feed channel 34, which is already rising again, part of the circumference of the mating roller 42, which is rotatably mounted on the rocker 48, protrudes through the other boundary wall 96 of the continuous paper feed channel 34 and, with a driven continuous paper feed roller 98, forms a pair of continuous paper feed rollers 100. An electromagnet 102 acts on the rocker 48 and, when it is attracted, presses the mating roller 42 against the driven single-sheet feed roller 38. When it has fallen back, the rocker 48 is pivoted by a tension spring 104 into its other position, in which the mating roller 42 is pressed against the fourth mating roller 98. The latter is driven in the direction opposite to that of the driven single-sheet feed roller 38 by a gear mechanism—illustrated symbolically as a crossed belt drive 106.

The co-rotating threading roller 92 is rotatably mounted on one arm 110 of a two-armed operating lever 108, on whose other arm 112 the threading push-button 94 acts. The operating lever 108 is mounted so that it can pivot on a journal 114 which is fixed to the printer frame. A blocking lever 116 which is hinged on the rocker 48 can be displaced in the direction of its longitudinal axis by the Eelectromagnet 102. A blocking pin 118 which projects into the adjusting path of one arm 110 protrudes from said blocking lever 116. When it is in its operated position, the threading push-button 94 closes a switch 120 whose function is described further below.

Figure 5:
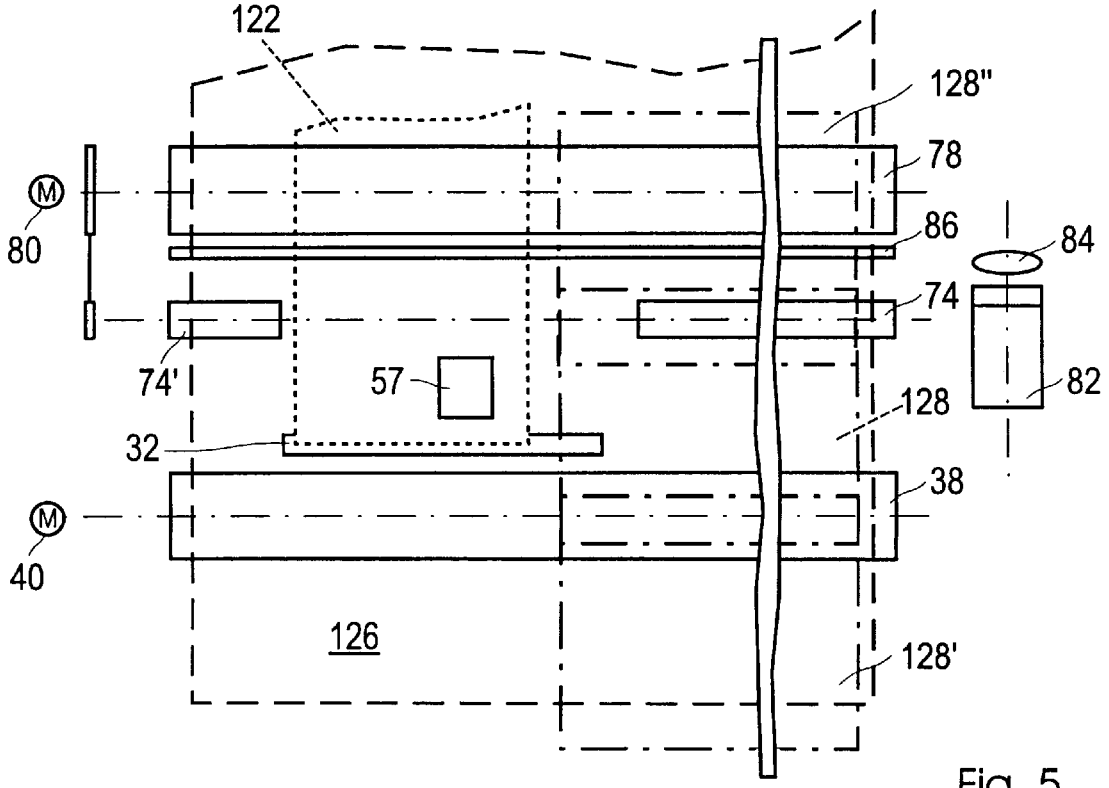
FIG. 5 is a front schematic view of the printing substrate plane of the printer illustrated in FIG. 2.

FIG. 5 shows the printing substrate plane of the printer 10 in a schematic front view. A continuous paper strip 122 emerges into the printing substrate slot 18 from the opening 32 of the continuous paper feed channel 34 (see FIGS. 1 and 2). As can be seen, it occupies only a specific area of the printing substrate plane. A single sheet 126, which covers the entire width of the printing substrate plane, and a short narrow document 128 are also shown, the latter in various positions 128', 128".

The driven single-sheet feed roller 38 and the co-rotating outer discharge roller 78 extend over the entire width of the printing substrate plane, while the area which is occupied by the continuous paper strip 122 is cut out of the inner pair of discharge rollers 66 (only their co-rotating roller 74 is illustrated).

The various operating states of the printer 10 will be described below with reference to FIGS. 2–5. FIG. 2 shows the printer in the rest position. The motors 40, 60 and 80 and the electromagnet 102 are deenergized. The mating roller 42 is therefore pressed against the driven continuous paper feed roller 98. In the picture, the continuous paper strip 122 has already been pushed a short distance into the continuous paper feed channel 34. As a result of the threading push-button 94 being operated (see FIG. 3), the co-rotating threading roller 92 is pressed against the driven outer discharge roller 76 and, at the same time, the switch 120 is operated. The discharge motor 80 and the feed motor 40 are therefore switched on, as a result of which the continuous paper strip 122 is conveyed by the pairs of rollers 93, 100, 70 into the printing substrate slot 18 and through the latter.

The cutting device 68 can subsequently be operated for a defined paper start.

Figure 4:
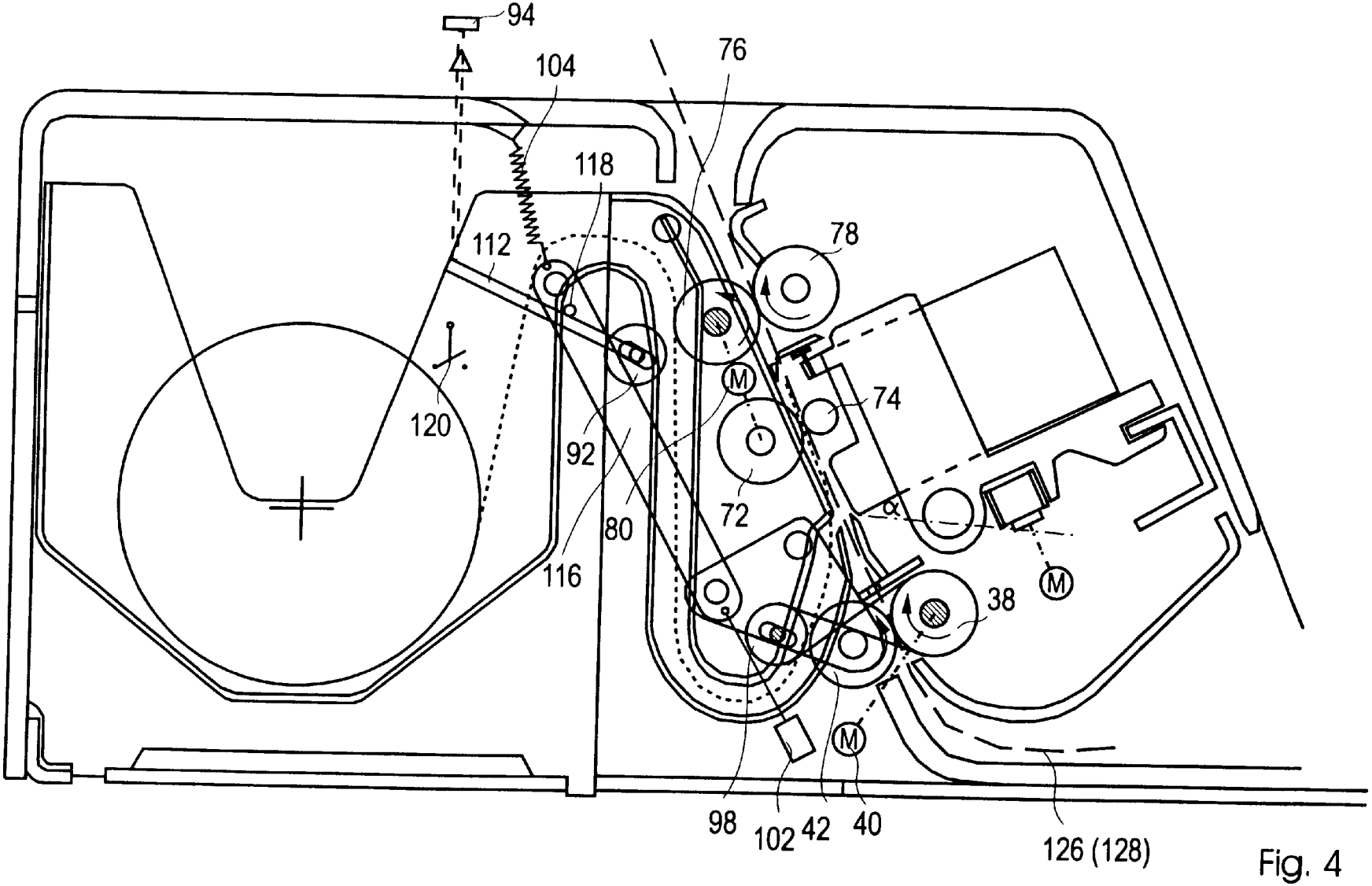
FIG. 4 is another sectional view of the printer shown in FIG. 1 but in a "convey single sheet" mode of operation.

Still referring to FIG. 3, a single sheet 126 or a document 128 on the feed table 20 has been pushed between the open pair of single-sheet feed rollers 44 as far as the document stop 50. As soon as the light barrier 54 detects the single sheet 126 or the document 128, and if there is no printing operation running at present on the continuous paper strip 122, the electromagnet 102 is energized, as a result of which the mating roller 42 disengages from the continuous paper strip 122 and engages with the single sheet 126 or the document 128. As a result of the displacement of the rocker 48, the document stop 50 is displaced at the same time in such a way that the single sheet 126 or the document 128 can pass through the window 52 as soon as the feed motor 40 is energized. It is of course also necessary for the discharge motor 80 to be energized for the purpose of discharge (FIG. 4).

In this mode of operation, which effects the processing of a single sheet, the blocking lever 116 is pulled downward by the electromagnet 102. The blocking pin 118 is thus located in the pivoting path of the operating lever 108, so that it is impossible to depress the threading push-button 94, that is to say the pair of threading rollers is inactive. Since the pair of continuous paper feed rollers 100 is also open, the continuous paper strip 122 cannot be advanced if there is a single sheet 12G or a document in the printing substrate slot 18.

While a long single sheet 126 could be passed on without problems from the pair of single-sheet feed rollers 44 to the outer pair of discharge rollers 70, the distance between these pairs of rollers is too great for short documents 128, such as check forms. For this reason, the inner pair of discharge rollers 66 is inserted between them. At the various document positions 128, 128', 128" illustrated in FIG. 5, it can be seen that the document is always in engagement with at least two pairs of rollers. In order to ensure straight-line guidance of the document, even in the case of short wide documents, part rollers 74, 74' of the pair of discharge rollers 66 are arranged on both sides of the area occupied by the continuous paper strip 122.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

We claim:

1. A printer comprising:

a printing station comprising a printing support and a printing head for printing on both a single sheet as well as at least one continuous strip, the printing station being in communication with a single feed channel and a continuous feed channel, the single feed channel being in communication with a feed table, the continuous feed channel being in communication with strip roll, the single sheet being driven through the single feed channel to the printing station by a single sheet roller and a mating roller, the single sheet roller and mating roller being disposed on opposing sides of the single feed channel, the continuous paper strip being driven through the continuous feed channel to the printing station by a continuous feed roller and the mating roller, the continuous feed roller and mating roller being disposed on opposing sides of the continuous feed channel, the mating roller being connected to a rocker pivotally mounted to the printer so that the mating roller can be pivoted between a first position where the mating roller engages the single sheet roller for driving the single sheet towards the printing station and a second position where the mating roller engages the continuous feed roller for driving the continuous strip toward the printing station.

2. The printer of claim 1 further comprising a discharge channel in communication with the printing station for outputting both the single sheet and the continuous strip, the printer further comprising a first pair of discharge rollers including a discharge roller and a driven roller disposed at least partially in the discharge channel on opposing sides thereof and downstream of the printing station.

3. The printer of claim 2 further comprising a cutting station disposed between the discharge roller and the printing station.

4. The printer of claim 1 further comprising a pair of threading rollers disposed at least partially in the continuous feed channel between the continuous feed roller and the strip roll, the threading rollers sandwiching the continuous strip only when the mating roller is in the second position.

5. The printer of claim 1 further comprising a discharge channel in communication with the printing station for outputting both the single sheet and continuous strip, the printer further comprising a driven roller and a discharge roller disposed at least partially in the discharge channel and on opposing sides of the discharge channel and downstream of the printing station, the driven roller also being at least partially disposed in the continuous feed channel, the printer further comprising a threading roller disposed opposite the continuous feed channel from the driven roller, the threading roller being connected to a lever and sandwiching the continuous strip between the threading roller and the driven roller only when the mating roller is in the second position.

6. The printer of claim 5 wherein the rocker is connected to an actuating arm, the actuating arm blocking movement of the threading roller towards the driven roller when the rocker is in the first position.

7. The printer of claim of claim 5 wherein movement of the lever is actuated by a threading push-button.

8. The printer of claim 1 further comprising a document stop disposed between the printing station and the single sheet and mating rollers, the document stop being connected to the rocker and permits the single sheet to be fed to the printing station only when the rocker is in the first position.

9. The printer of claim 2 further comprising a second pair of discharge rollers which are driven in synchronism with the driven roller, the second pair of discharge rollers being disposed at least partially in the discharge channel and on opposing sides thereof and between the printing station and the driven roller, the second pair of discharge rollers not engaging the continuous strip.

10. The printer of claim 1 wherein the printing head is an inkjet printing head.

11. A printer comprising:

a printing station comprising a printing support and a printing head for printing on both a single sheet as well as at least one continuous strip, the printing station being in communication with a single feed channel and a continuous feed channel, the single feed channel being in communication with a feed table, the continuous feed channel being in communication with strip roll, the single sheet being driven through the single feed channel to the printing station by a single sheet roller and a mating roller, the single sheet roller and mating roller being disposed on opposing sides of the single feed channel, the continuous paper strip being driven through the continuous feed channel to the printing station by a continuous feed roller and the mating roller, the continuous feed roller and mating roller being disposed on opposing sides of the continuous feed channel, the mating roller being connected to a rocker pivotally mounted to the printer so that the mating roller can be pivoted between a first position where the mating roller engages the single sheet roller for sandwiching the single sheet therebetween and for driving the single sheet towards the printing station and a second position where the mating roller engages the continuous feed roller for sandwiching the continuous strip therebetween and for driving the continuous strip toward the printing station, the printer further comprising a discharge channel in communication with the printing station for outputting both the single sheet and continuous strip, the printer further comprising a driven roller and a discharge roller disposed at least partially in the discharge channel and on opposing sides of the discharge channel and downstream of the printing station, the driven roller also being at least partially disposed in the continuous feed channel, the printer further comprising a threading roller disposed opposite the continuous feed channel from the driven roller, the threading roller being connected to a movable lever, the threading lever capable of sandwiching the continuous strip between the threading roller and the driven roller only when the mating roller is in the second position.

12. The printer of claim 1 further comprising a cutting station disposed between the discharge roller and the printing station.

13. The printer of claim 1 wherein the rocker is connected to an actuating arm, the actuating arm blocking movement of the threading roller towards the driven roller when the rocker is in the first position.

14. The printer of claim of claim 13 wherein movement of the lever is actuated by a threading push-button.

15. The printer of claim 1 further comprising a document stop disposed between the printing station and the single sheet and mating rollers, the document stop being connected to the rocker and permits the single sheet to be fed to the printing station only when the rocker is in the first position.

16. The printer of claim 1 further comprising a second pair of discharge rollers which are driven in synchronism with the driven roller, the second pair of discharge rollers being disposed at least partially in the discharge channel and on opposing sides thereof and between the printing station and the driven roller, the second pair of discharge rollers not engaging the continuous strip.

17. The printer of claim 1 wherein the printing head is an inkjet printing head.

18. A printer comprising:

a printing station comprising a printing support and a printing head for printing on both a single sheet as well as at least one continuous paper strip, the printing station being in communication with a single feed channel and a continuous feed channel, the single feed channel being in communication with a feed table, the continuous feed channel being in communication with paper strip roll, the single sheet being driven through the single feed channel to the printing station by a single sheet roller and a mating roller, the single sheet roller and mating roller being disposed on opposing sides of the single feed channel, the continuous paper strip being driven through the continuous feed channel to the printing station by a continuous feed roller and the mating roller, the continuous feed roller and mating roller being disposed on opposing sides of the continuous feed channel, the mating roller being connected to a rocker pivotally mounted to the printer so that the mating roller can be pivoted between a first position where the mating roller engages the single sheet roller for driving the single sheet towards the printing station and a second position where the mating roller engages the continuous feed roller for driving the continuous strip toward the printing station, the printer further comprising a discharge channel in communication with the printing station for outputting both the single sheet and continuous strip, the printer further comprising a driven roller and a discharge roller disposed at least partially in the discharge channel and on opposing sides of the discharge channel and downstream of the printing station, the driven roller also being at least partially disposed in the continuous feed channel, the printer further comprising a threading roller disposed opposite the continuous feed channel from the driven roller, the threading roller being connected to a lever, the rocker being connected to an actuating arm, the actuating arm blocking movement of the threading roller towards the driven roller when the rocker is in the first position, the printer further comprising a cutting station disposed between the driven roller and the printing station, the printer further comprising a document stop disposed between the printing station and the single sheet and mating rollers, the document stop being connected to the rocker and permits the single sheet to be fed to the printing station only when the rocker is in the first position.

19. The printer of claim 18 further comprising a second pair of discharge rollers which are driven in synchronism with the discharge roller and driven roller, the second pair of discharge rollers being disposed at least partially in the discharge channel and on opposing sides thereof and between the printing station and the driven roller, the second pair of discharge rollers not engaging the continuous strip.

20. The printer of claim 18 wherein the printing head is an inkjet printing head.

* * * * *